US009844784B2

(12) United States Patent
Haase

(10) Patent No.: US 9,844,784 B2
(45) Date of Patent: Dec. 19, 2017

(54) GRINDING DEVICE

(71) Applicant: GBF Gesellschaft Fuer Bemessungsforschung MBH, Aachen (DE)

(72) Inventor: Ralf Haase, Aachen (DE)

(73) Assignee: GBF Gesellschaft Fuer Bemessungfsforschung MBH, Aachen (DE)

( * ) Notice: Subject to any disclaimer, the term of this patent is extended or adjusted under 35 U.S.C. 154(b) by 0 days.

(21) Appl. No.: 14/619,266

(22) Filed: Feb. 11, 2015

(65) Prior Publication Data

US 2015/0298133 A1 Oct. 22, 2015

Related U.S. Application Data

(63) Continuation of application No. PCT/EP2013/067404, filed on Aug. 21, 2013.

(30) Foreign Application Priority Data

Aug. 22, 2012 (DE) ..... 10 2012 107 729

(51) Int. Cl.

| | |
|---|---|
| ***B02C 15/04*** | (2006.01) |
| ***B02C 4/32*** | (2006.01) |
| ***B02C 4/34*** | (2006.01) |
| ***B02C 15/00*** | (2006.01) |

(52) U.S. Cl.

CPC ..... *B02C 15/04* (2013.01); *B02C 4/32* (2013.01); *B02C 4/34* (2013.01); *B02C 15/007* (2013.01)

(58) Field of Classification Search

CPC ..... B02C 15/04; B02C 15/007; B02C 4/34; B02C 4/32

USPC ..... 241/117–121

See application file for complete search history.

(56) References Cited

U.S. PATENT DOCUMENTS

| | | | |
|---|---|---|---|
| 4,002,299 | A | 1/1977 | Skalka |
| 4,610,401 | A | 9/1986 | Maliszewski |

FOREIGN PATENT DOCUMENTS

| | | | |
|---|---|---|---|
| DE | 3639206 | C1 | 1/1988 |
| DE | I02008046921 | A1 | 4/2010 |
| DE | 202009004025 | U1 | 8/2010 |
| EP | 2408565 | B1 | 1/2012 |
| GB | 942804 | A | 11/1963 |
| GB | 943450 | A | 12/1963 |
| WO | WO2009067828 | A1 | 6/2009 |

*Primary Examiner* — Mark Rosenbaum

(74) *Attorney, Agent, or Firm* — Von Rohrscheidt Patents

(57) ABSTRACT

A grinding device, in particular a vertical mill for grinding a grinding material, the grinding device including at least two grinding elements that are movable relative to one another, wherein the two grinding elements together form at least one grinding portion in which the grinding material is grindable by the two grinding elements; and at least one contact pressure device including at least one hydraulic cylinder including a cylinder operating chamber and at least one gas spring including a spring operating chamber, wherein the cylinder operating chamber and the spring operating chamber are flow connected with one another, wherein a contact force is impartible upon at least one of the grinding elements by the at least one contact pressure device and the grinding elements are pressable onto one another by the contact force.

13 Claims, 7 Drawing Sheets

GRINDING DEVICE

RELATED APPLICATIONS

This application is a continuation of International Application PCT/EP2013/067404 filed on Aug. 21, 2013 claiming priority from German patent application DE 10 2012 107 729.0 filed on Aug. 22, 2012, both of which are incorporated in their entirety by this reference.

FIELD OF THE INVENTION

The present invention relates to a grinding device, in particular a vertical mill for grinding a grinding material, the grinding device including a) at least two grinding elements that are movable relative to one another, wherein the two grinding elements together form at least one grinding portion in which the grinding material is grindable by the two grinding elements; and b) at least one contact pressure device including at least one hydraulic cylinder including a cylinder operating chamber and at least one gas spring including a spring operating chamber, wherein the cylinder operating chamber and the spring operating chamber are flow connected with one another, wherein a contact force is impartible upon at least one of the grinding elements by the at least one contact pressure device and the grinding elements are pressable onto one another by the contact force.

The term "grinding device" according to the instant application only includes grinding devices which are to be used in production processes. In particular grinding devices shall not be included which are only used for experimental and research and development purposes.

The term grinding element can relate to elements that actively impact the grinding material, for example actively driven rolling cylinders of a roller assembly and also passive and optionally stationary elements which are for example only used as a base for the grinding material and are thus used as an opposite part for an additional grinding element that actively imparts compression and/or shear forces. In any case a relative movement of at least two grinding elements has to be performed in order to achieve a grinding result.

With respect to a "flow connection" of the cylinder operating chamber with the spring operating chamber it is irrelevant as a matter of principle whether this connection is only formed by a two dimensional flow cross section, a connecting element, for example configured as a tubular conduit or is even formed by a plurality of different connecting elements.

The designation cylinder operating chamber designates a space within a hydraulic cylinder that is filled with a hydraulic fluid. It is a space in which a piston of the hydraulic cylinder is typically movable.

The "spring operating chamber" designates an entire space that is provided in an interior of the gas spring which is typically partly filled with a hydraulic fluid and which furthermore includes a gas cushion of the gas spring. Depending on a condition of the gas spring, accordingly the spring operating chamber can be filled in various portions with the hydraulic fluid and the gas of the gas cushion.

BACKGROUND OF THE INVENTION

Grinding devices of the general type described supra have been known for quite a while and are used in a plurality of applications. Exemplary embodiments are a so called roller mill and a so called vertical mill.

A roller mill typically includes two horizontal rolling cylinders which rotate opposite to one another, wherein both rolling cylinders have a minimum distance from one another or are in contact with one another at a knuckle where they form a grinding portion. The material to be ground or grinding material is introduced from a top side of the grinding portion between the two roller cylinders, wherein the individual particles of the grinding material stream pass through the grinding portion and are ground. Grinding devices of this type are used for example for grinding grain. An exemplary embodiment can be derived among others from WO 2009/067828 A1.

Vertical mills, however, are mills in which the grinding material is placed onto a horizontally arranged grinding table which rotates about a vertically oriented axis. In an outer circumferential edge portion of the grinding table in which the grinding material is collected based on the impacting centrifugal forces, typically plural so called roller mills are arranged whose rolling elements are formed by vertically standing rollers, whose rotation axis is horizontally oriented. The grinding portion in this type of mills is between a respective bottom side of the roller and the grinding table wherein due to the rotation of the grinding table about the vertical axis the grinding material is continuously moved along under the roller. Thus, the roller is pressed in a direction towards the grinding table, wherein the weight of the roller and also external pressing forces that are applied by the contact pressure device become effective. Under this pressure that is imparted by the roller onto the grinding material the grinding material is ground. Vertical mills of this type are typically used in the concrete industry. An exemplary embodiment can be derived among others from DE 10 2008 046 921 A1.

In particular the latter vertical mills that are known in the art have a basic problem in that they tend to enter an instable vibration condition which is commonly referred to as "rumbling". In this condition the grinding device is vibrating which causes the roller and the grinding table to move relative to one another in a vertical direction, this means the roller is at least lifted by the grinding bed formed by the grinding material and can even lift off and subsequently presses or impacts on the grinding bed again. Here dynamic forces in an order or magnitude of several mega Newton [MN] can be at work so that the vertical mill can be damaged quite easily. For example a roller jacket which circumferentially envelops the roller is subject to a very high load in this instable vibration condition.

During operation of such grinding devices accordingly there is a long felt need to avoid these load conditions. Therefore monitoring systems are typically installed which detect particular operating parameters of the mill which eventually shall be used for drawing reverse conclusions with respect to a critical load. As a result there is the problem that shut downs and thus economically disadvantageous idle times of the mill occur due to anticipation of an impending resonance. Furthermore it happens from time to time that the described "rumbling" of the mill occurs in spite of these monitoring strategies.

The recited DE 10 2008 046 921 A1 relates among other things to this problem and attempts to monitor the grinding device so that critical load conditions are detected reliably and early, wherein the dynamic forces impacting the rollers shall be detected in particular frequency ranges and a shutdown of the entire grinding device shall be performed when reaching a threshold value.

In another document, EP 2 408 565 B1, the problem of rumbling mills is also discussed. The document describes a vertical mill whose contact pressure device is configured as an "open system". This means that the contact pressure device which is formed by the at least one hydraulic cylinder and the at least one gas spring additionally includes at least one hydraulic pump through which an oil pressure in the at least one hydraulic cylinder and/or the at least one gas spring can be continuously adapted. In particular EP 2 408 565 B1 described that the effect of the hydraulic pump can load a lower pressure chamber of the hydraulic cylinder with pressure which causes the corresponding roller mill to "lift off", this means that at least one contact pressure of the roller mill is reduced, optionally even a contact between the roller mill and the grinding bed is completely lost. This shall help to quiet the resonating mill system.

A disadvantage of the latter system is on the one hand side the complexity of the open pressure system which requires operating a hydraulic pump. On the other hand side the disclosed device as such is not free from disadvantageous vibration conditions ("rumbling") but only provides a system which shall resolve the rumbling in a particularly simple manner should it occur.

Regardless, EP 2 408 565 B1 also provides a prevention strategy with regard to rumbling wherein the prevention strategy is based on a pressure adaptation of the rolling mills based on the effect of the hydraulic pump, wherein a pressure adaptation is used in the opposing pressure chambers of the hydraulic cylinders. This control system, however, is complex and slow since a pressure buildup by the hydraulic pump as a counter measure against a critical resonance that builds up takes a rather long time period, thus an entry of the mill system into resonance probably cannot be prevented in a timely manner.

Therefore a system which reliably prevents the risk of rumbling is not known in the art at all.

BRIEF SUMMARY OF THE INVENTION

Thus, it is an object of the instant invention to provide a grinding device which is not prone to enter the described instable vibration condition recited supra.

The technical task is accomplished improving upon a grinding device recited supra and providing grinding device, in particular a vertical mill for grinding a grinding material, the grinding device including at least two grinding elements that are movable relative to one another, wherein the two grinding elements together form at least one grinding portion in which the grinding material is grindable by the two grinding elements; and at least one contact pressure device including at least one hydraulic cylinder including a cylinder operating chamber and at least one gas spring including a spring operating chamber, wherein the cylinder operating chamber and the spring operating chamber are flow connected with one another, wherein a contact force is impartible upon at least one of the grinding elements by the at least one contact pressure device and the grinding elements are pressable onto one another by the contact force, wherein a smallest flowable cross-sectional surface between the cylinder operating chamber and the spring operating chamber amounts to at least 10% of a cross-sectional surface of the cylinder operating chamber and/or a connecting section extending between a first transitional cross-section of a connecting component communicating with the cylinder operating chamber, and a second transitional cross-section of the connecting component communicating with the spring operating chamber; wherein the connecting section has a maximum length of 100 cm.

The smallest cross sectional surface between the cylinder operating chamber and the spring operating chamber is thus always the sum of the cross sectional surfaces connected in parallel which are available to the hydraulic fluid for flowing from the cylinder operating chamber into the spring operating chamber. In case a single spring operating chamber with ten respective individual conduits connected in parallel in the form of tubular conduits which respectively have a constant cross sectional surface of 5 $cm^2$ are connected to the cylinder operating chamber the "smallest" cross sectional surface according the instant application is computed as $A=10*5=50\ cm^2$, since this is actually the smallest cross sectional surface which is available to the hydraulic fluid to flow into the spring operating chamber. Analogously individual cross sectional surfaces of individual connecting elements between a cylinder operating chamber and plural spring operating chambers add up in case the gas springs are connected in parallel to the cylinder operating chamber.

The present invention is based on the finding that the resonance problem (rumbling) of the known grinding device is caused by a stiffening of the entire grinding device. It was further found that this stiffening is substantially caused by a stiffening of the contact pressure device which is caused in particular by the fact that the gas spring connected at the hydraulic cylinder is no longer effective anymore in prior art grinding devices in the range of high frequency vibrations to which grinding devices are typically subjected. This means that hydraulic fluid that is provided in the hydraulic cylinder cannot flow over into the gas spring. The gas spring is used as a matter of principle to provide an expansion chamber for the hydraulic fluid that is arranged in the cylinder operating chamber, wherein the hydraulic fluid can flow into the compensation chamber as soon as a piston of the hydraulic cylinder is displaced.

The underlying problem is subsequently discussed with reference to a vertical mill configured as a roller mill.

A piston of a hydraulic cylinder in a roller mill according to the invention is typically directly connected with a bearing axis of the roller mill and substantially provides the contact pressure for the roller which forms a grinding element herein and impacts the grinding material. When the roller of the roller mill is deflected in a vertical direction which continuously occurs when the grinding material is rolled over the bearing axis of the roller of the roller mill rises together with the roller and consequently also the piston of the hydraulic cylinder rises which piston is thus moved in the hydraulic cylinder. In the course of this movement the hydraulic fluid is at least partially displaced into the gas spring connected to the cylinder operating chamber or it is displaced into the spring operating chamber, wherein typically hydraulic fluid is permanently located in the spring operating chamber of the gas spring and in a connection cross section or in a connection component between the cylinder and the spring operating chamber. Introducing additional hydraulic fluid into the gas spring compresses a gas cushion in the spring operating chamber which gas cushion is typically formed from nitrogen and an additional reset force is created on top of the preload that is already applied. This has the effect that the hydraulic fluid tends to flow back into the cylinder operating chamber, wherein the piston of the hydraulic cylinder and consequently also the roller are pressed back in vertical downward direction onto the grinding bed.

When a sudden and strong displacement of the roller of the vertical mill occurs during the grinding process, for example when rolling over a particularly large particle in the grinding material a sudden displacement of the piston in the hydraulic cylinder and consequently an acceleration of the hydraulic fluid in the cylinder operating chamber occurs as described.

Due to this acceleration of the hydraulic fluid in the cylinder operating chamber analogously also the hydraulic fluid has to be accelerated and displaced which is arranged in the connection cross section between the cylinder operating chamber and in the spring operating chamber. In the art this connection cross section which is typically defined by a tubular connection element has a much smaller cross sectional surface than the cylinder operating chamber (c.f. for example FIG. 1 of DE 10 2008 046 921 A1). This "constriction" of a flowable cross section (leap from cross section of the cylinder operating chamber to the connection element or the connection cross section) which is imposed upon the hydraulic fluid has the effect that a higher flow velocity of the hydraulic fluid has to be provided in the connection cross section, wherein the increase in flow velocity is inverse proportional to the cross section contraction. In the present case due to the high occurring vibration frequency the increase in flow velocity has the effect that the hydraulic fluid in the connection cross section has to be accelerated accordingly fast. This acceleration applied to the hydraulic fluid in the connection cross section is therefore many times higher than in the cylinder operating chamber.

Large forces are required to cause this acceleration. However, the prior art only provides a rather small connection cross section so that the hydrostatic pressure of the hydraulic fluid has only a small "effective surface", namely only the connection cross section. This has the effect that the hydraulic fluid arranged in the connection cross section is not accelerated and consequently not moved; thus the spring operating chamber cannot be activated as a compensation chamber for the hydraulic fluid at all. When the roller of the grinding device is displaced this displacement cannot be compensated with a movement of the piston since the piston remains in its original position for the moment and does not permit any vertical movement of the bearing axis of the vertical mill. Instead, the entire foundation may be deformed on which the vertical mill is based, wherein the extremely high stiffness of the entire system eventually causes the extreme forces recited supra due to the dislocation of the roller wherein the forces can eventually cause the damages that occur in the prior art.

The features according to the invention which can be implemented as alternatives or advantageously together help to prevent this very disadvantageous effect of the known grinding devices.

Thus, it is possible on the one hand side to set the minimal or smallest cross sectional value to a minimum value which shall be at least 10% of the cross sectional surface of the operating cylinder. This predetermination of a "minimum size" of the smallest cross sectional surface assures that the ratio of accelerations between the cylinder operating chamber and the connection cross section is limited to a maximum value, thus the force required to accelerate the hydraulic fluid in the connection cross section is limited in upward direction. This helps to prevent that the resistance of the hydraulic fluid embodied as inertia increases in the smallest cross section surface beyond a maximum value which stiffens the entire grinding device. This solution is particularly advantageous.

On the other hand side it is also possible according to the invention alternatively or also additionally although rather complicated to limit the connection distance according to the description provided supra to the recited maximum length. This is provided in view of the fact that a short connection distance causes a rather small volume of hydraulic fluid in the connection cross section. In analogy to the volume of hydraulic fluid thus consequently also the mass provided in the connection cross section is limited to a maximum amount. The force [F] which is required to accelerate a mass [m] with a particular acceleration is determined by the equation F=m*a. This means that the required force to accelerate the hydraulic fluid can be applied even when the cross sectional ratio of the cross sectional surface of the cylinder operating chamber to the smallest cross sectional surface between the cylinder operating chamber and the spring operating chamber should be below the recited 10%. Conductor lengths illustrated in the prior art substantially exceed the claimed values and show that the problems discussed supra are not understood in the prior art.

Advantageously the recited minimum ratio of the cross sectional surface according to the invention and the maximum connection distance between cylinder operating chamber and spring operating chamber are combined.

A blockade or deactivation of the gas spring as it occurs according to the prior art is permanently prevented by the grinding device according to the invention according to the description provided supra and thus the object is achieved.

In a particularly advantageous embodiment of the grinding device according to the invention the smallest flowable cross sectional surface between the cylinder operating chamber and the spring operating chamber is at least 20%, advantageously at least 20%, further advantageously at least 80% of a cross sectional surface of the cylinder operating chamber. These additional larger ratios are particularly advantageous for an efficient operation of the grinding device according to the invention. In particular an inertial force occurring at the connection cross section can be further reduced which can lead to a far reaching slimming of the entire grinding device in particular to a reduction of its foundation mass.

In another advantageous embodiment of the device according to the invention it is proposed to limit the connection distance to a maximum length of 60 cm, advantageously at the most 30 cm, further advantageously at the most 10 cm. In analogy to the preceding discussion this causes an additional reduction of the inertial forces and thus a substantial size and weight reduction of the entire grinding device.

In another advantageous embodiment of the grinding device according to the invention it is proposed to configure the at least one gas spring as a bladder reservoir. Reservoirs of this type are particularly easily available and can be installed in retrofit solutions for already existing grinding devices with reasonable complexity.

Particularly advantageously a plurality of gas springs that is connected to the hydraulic cylinder in parallel is provided in this context, wherein the parallel connected connection cross sections between the cylinder operating chamber and the individual operating chambers of the individual gas springs are added up to form a cross sectional surface according to claim 1 which is available to the hydraulic fluid and based on which the ratio according to the characterizing feature of claim 1 is computed.

In a particularly advantageous embodiment of the grinding device according to the invention a damping device is provided by which a flow velocity of the hydraulic fluid flowing between the cylinder operating chamber and the spring operating chamber is reducible, advantageously a degree of damping of the damping device for different flow directions of the hydraulic fluid has different magnitudes, wherein further advantageously the degree of damping for a flow of the hydraulic fluid in a direction oriented away from the piston of the hydraulic cylinder is greater than for a flow of the hydraulic fluid in reverse direction. Providing a damping device is advantageous as a matter of principle since an excitation of the roller caused by the grinding bed or the grinding material and thus an excitation of the hydraulic fluid are dampened and disadvantageous vibrations and disadvantageous reset forces can be prevented.

Configuring a tension stage and a compression stage of the damper differently is advantageous in this context, thus a different embodiment of the degree of damping achieved by the damping device which should advantageously be less for a lifting of the roller, thus a flow direction of the hydraulic fluid in a direction of the spring operating chamber, than in reverse direction. This way it is rather "easy" to lift the roller off from the grinding bed, however braking is performed when the roller is returned so that an unnecessary hard impact of the roller on the grinding bed is prevented. This is particularly helpful to keep wear of the roller of the vertical mill as small as possible and in order to not deform the grinding bed unnecessarily as it happens in the prior art ("wash board").

In order to achieve maximum flexibility of the grinding device it is furthermore particularly advantageous when the degree of damping of the damping device is variable as a function of the flow direction of the hydraulic fluid. This way it is possible for an operator to configure the damping device for example for different grinding materials or different consistencies of the same grinding material.

In a particularly advantageous embodiment of the damper device, the damper device is formed by a throttle plate including pass through openings wherein the damping device advantageously also includes at least one blocking device that is moveable relative to the throttle plate and through which the pass through openings of the throttle plate are at least partially closeable. A damper device of this type can be produced in a particularly simple manner and is adjustable in a particularly simple manner through the blocking device.

In another particularly advantageous embodiment of the grinding device according to the invention the hydraulic cylinder and the gas spring are configured as an integrated contact pressure device, wherein the cylinder operating chamber and the spring operating chamber transition into one another seamlessly, wherein in particular the hydraulic fluid is arranged between a piston of the contact pressure device and a gas cushion of the contact pressure device. In this embodiment the cylinder operating chamber and the spring operating chamber geometrically speaking are the same operating chamber, wherein functionally speaking a sub division into cylinder operating chamber and spring operating chamber in the sense of the preamble of claim 1 is still possible. The smallest cross sectional surface in the sense of claim 1 is formed in this embodiment by the cross section of the cylinder operating chamber or the spring operating chamber itself so that a ratio of the smallest cross sectional surface to the cross sectional surface of the cylinder operating chamber is 100% in this case.

This suggested integrated embodiment is implementable in a particularly simple manner and is recommended accordingly for grinding devices to be newly constructed.

Furthermore an embodiment of this type of the grinding device according to the invention is particularly advantageous in which the contact pressure force that is applicable by the contact pressure device is variable. This facilitates maximum adaptability of the grinding device for the respective grinding material.

It is furthermore particularly advantageous when the at least one hydraulic cylinder and the at least one gas spring form a closed hydraulic system. Thus, a "closed hydraulic system" is a system where a pressure ("preload") externally applied from an outside to the system including the hydraulic cylinder and the gas spring is kept constant in that the system is closed. An option for the hydraulic fluid or another component provided in the system to escape is as impossible as adding such component. In particular a closed hydraulic system does not include any hydraulic pump that is permanently connected with the hydraulic system through which a pressure in the contact pressure device is continuously adapted, thus continuously increased or reduced. Though a hydraulic pump is typically provided in order to perform a pressure correction as required. The hydraulic pump, however, is decoupled from the hydraulic system which is typically achieved by locked pressure conduits which are only opened when required.

In another advantageous embodiment of the grinding device according to the invention the at least one hydraulic cylinder includes at least one cylinder operating chamber. A hydraulic cylinder of this type is comparatively simple and performs all necessary functions as an element of the contact pressure device. In particular it is not necessary in the grinding device according to the invention to provide a "lower pressure chamber" below the piston of the hydraulic cylinder through which lower pressure chamber the piston can be lifted through an externally applied pumping power in the hydraulic cylinder which would simultaneously lift the grinding element configured as the roller. In the prior art similar configurations are used to mitigate the risk of reaching critical resonance and to lift the roller from its grinding bed when necessary. Since the grinding device according to the invention does not have an inherent risk of reaching resonance any more a hydraulic cylinder with two cylinder operating chambers is not necessary.

BRIEF DESCRIPTION OF THE DRAWINGS

The invention is now described in more detail based on embodiments with reference to drawing figures, wherein.

DETAILED DESCRIPTION OF THE INVENTION

Figure 1:
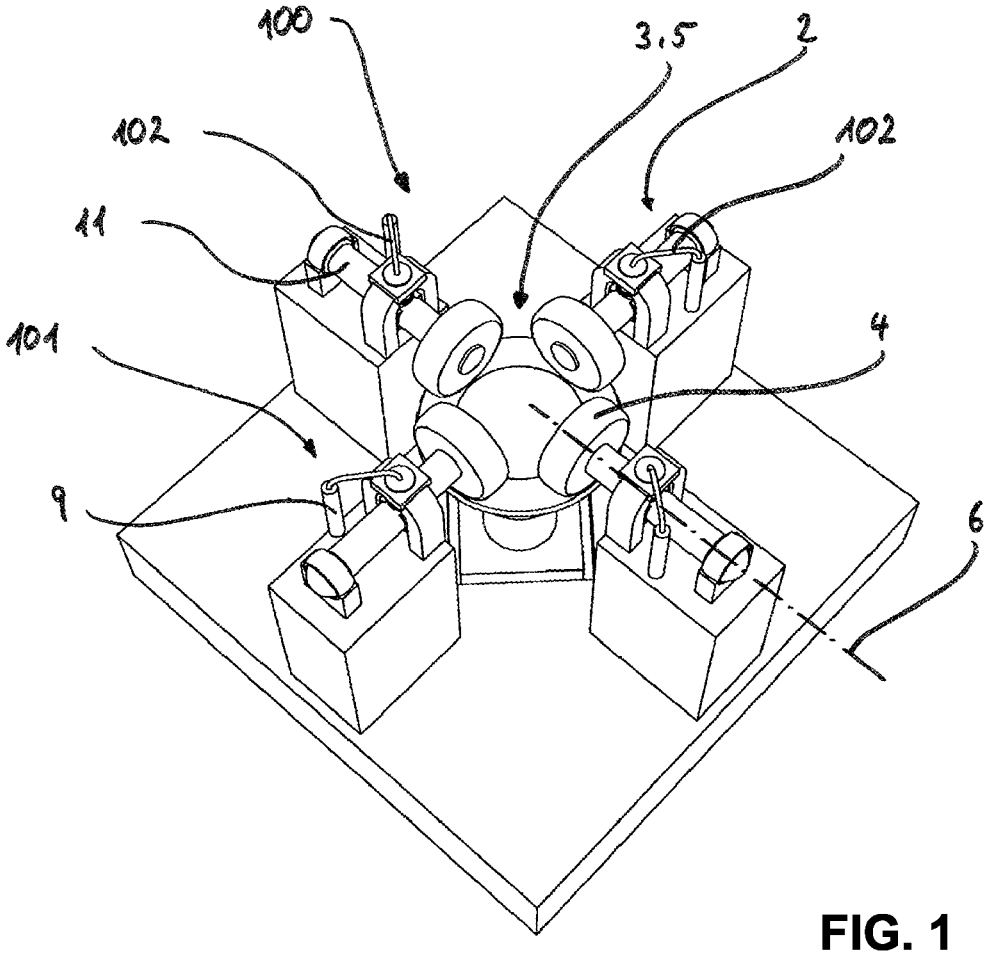
FIG. 1 illustrates a known grinding device.

A first embodiment which is illustrated in FIG. 1 illustrates a known grinding device 100 wherein the illustration according to FIG. 1 is reduced to essential components of the grinding device 100. The grinding device 100 illustrated herein is a so called vertical mill. The vertical mill includes a total of 5 grinding elements 2, 3 wherein four grinding elements 2 interact as rollers 4 with the grinding elements 3 configured as a grinding plate 5. Grinding material which is not illustrated herein is arranged on the grinding plate 5.

The grinding plate 5 is driven by a drive device that is not illustrated so that it rotates about a vertical axis. The movement of the grinding plate 5 moves the grinding material arranged thereon, wherein the grinding material is moved along under the rollers 4 wherein the rollers are being dragged, this means they rotate about a horizontal rotation axis 6 solely due to the rotation of the grinding plate 5. There is no active drive for the rollers 4, but it can be easily implemented.

The rollers 4 are preloaded in a vertical direction by a contact pressure device 101, this means they are pressed by the contact pressure device 101 in a direction towards the grinding plate 5 or towards a grinding bed formed from the grinding material. Under a pressure of the contact pressure device 101 and under a weight of the rollers 4 the grinding material is ground on the grinding plate 5, wherein the rollers and the grinding plate, thus the grinding elements 2, 3 move relative to one another.

The contact pressure device 101 includes a hydraulic cylinder 8 which is not visible in FIG. 1 and a gas spring 9. Both components are flow connected by a flow connector 102 which is provided as a tubular conduit. A spring operating chamber of the gas spring 9 includes a gas cushion which is formed from nitrogen. A cylinder operating chamber of the hydraulic cylinder 8, the connector 102 and a portion of the spring operating chamber of the gas spring 9 arranged outside of the gas cushion are filled with a hydraulic fluid.

When a vertical displacement of one of the roller 4 occurs during operation of the grinding device 100 a piston of the hydraulic cylinder 8 of the contact pressure device 101 which piston is connected with a bearing axle 11 of the roller 4 is moved in a vertical direction. Thus, the piston displaces the hydraulic fluid provided in the cylinder operating chamber wherein the hydraulic fluid subsequently flows at least partially through the connector 102 into the spring operating chamber of the gas spring 9. Thus, the gas cushion in the gas spring 9 is compressed and an additional reset force is generated on top of the preload recited supra wherein the reset force is stored as potential energy in the gas when the gas cushion is compressed. As soon as the roller 4 can move back again towards the grinding bed or the grinding plate 5, the hydraulic fluid is pressed from the spring operating chamber of the gas spring back into the cylinder operating chamber of the hydraulic cylinder 8 and the piston of the hydraulic cylinder 8 is accordingly moved back into its prior position.

A smallest flowable cross sectional surface of the connection component 102 of the grinding device 100 is particularly small relative to a cross sectional surface of the cylinder operating chamber and only amounts to a few percent of the cylinder operating chamber, thus approximately 2%. This typical embodiment that is known in the art causes the problems recited supra in detail.

Furthermore a connection distance which extends between the cylinder operating chamber of the hydraulic cylinder 8 and the spring operating chamber of the gas spring 9 within the connection component 102 is approximately 200 cm long in the illustrated embodiment. Thus, a total amount of hydraulic fluid is accumulated in the connecting component 102 so that a substantial force would be required for an instantaneous acceleration of this hydraulic fluid which force cannot be applied due to the very small available cross sectional surface of the connecting component 102. Consequently the connecting component 102 that is known in the art acts as a "plug" which almost prevents a flow of the hydraulic fluid from the hydraulic cylinder 8 to the gas spring 9 in a range of high load frequencies.

Figure 2:
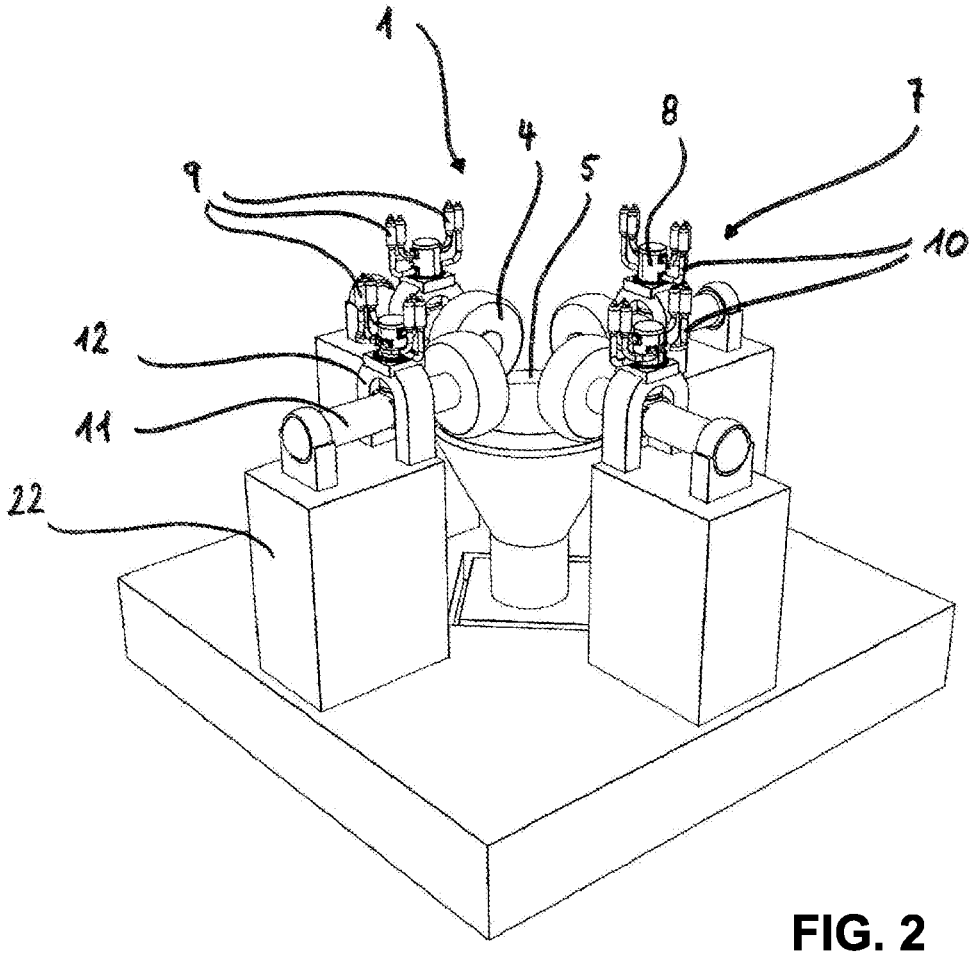
FIG. 2 illustrates a first grinding device according to the invention with a plurality of individual gas springs.

This problem is solved by a first embodiment of a grinding device 1 according to the invention which is illustrated in FIG. 2. The grinding device 1 illustrated herein includes a contact pressure device 7 which is mounted at a so called force frame 12 through which the forces caused by the contact pressure device 7 are reacted in a foundation 22. Like in the grinding device 100 the piston of the hydraulic cylinder 8 is mounted on the bearing axle 11 of the roller 4 in order to push down the roller 4 by the bearing axle 11, thus to press it onto the grinding bed.

In the illustrated embodiment the hydraulic cylinder 8 extends with a constant cross section above the force frame 12. At each hydraulic cylinder 8 a total of six gas springs 8 are connected which are respectively flow connected with a proper connector 10 with the cylinder operating chamber of the hydraulic cylinder 8. The connectors 10 are easily recognizable in a detailed representation according to FIG. 3. The individual connectors 10 are substantially similar to the connector 102 of the grinding device 100 with respect to their smallest cross sectional surface. However, contrary to the grinding device 100 known in the art plural connectors 10 are connected in parallel so that the hydraulic fluid which is displaced from the hydraulic cylinder 8 during a piston movement is overall provided with a cross sectional surface through which it can exit from the cylinder operating chamber, wherein the cross sectional surface corresponds to six times an individual cross sectional surface of each connecting component 10. This way a surface ratio of the smallest cross section surface (equals six times the smallest cross section surface of the six individual connection components 10) between the cylinder operating chamber and the spring operating chamber relative to the cross sectional surface of the cylinder operating chamber of approximately 40% is provided in the illustrated embodiment.

This significant enlargement of the flowable cross section according to the invention resolves the previously described "plugging effect" or the stiffening effect of the connector.

Figure 3:
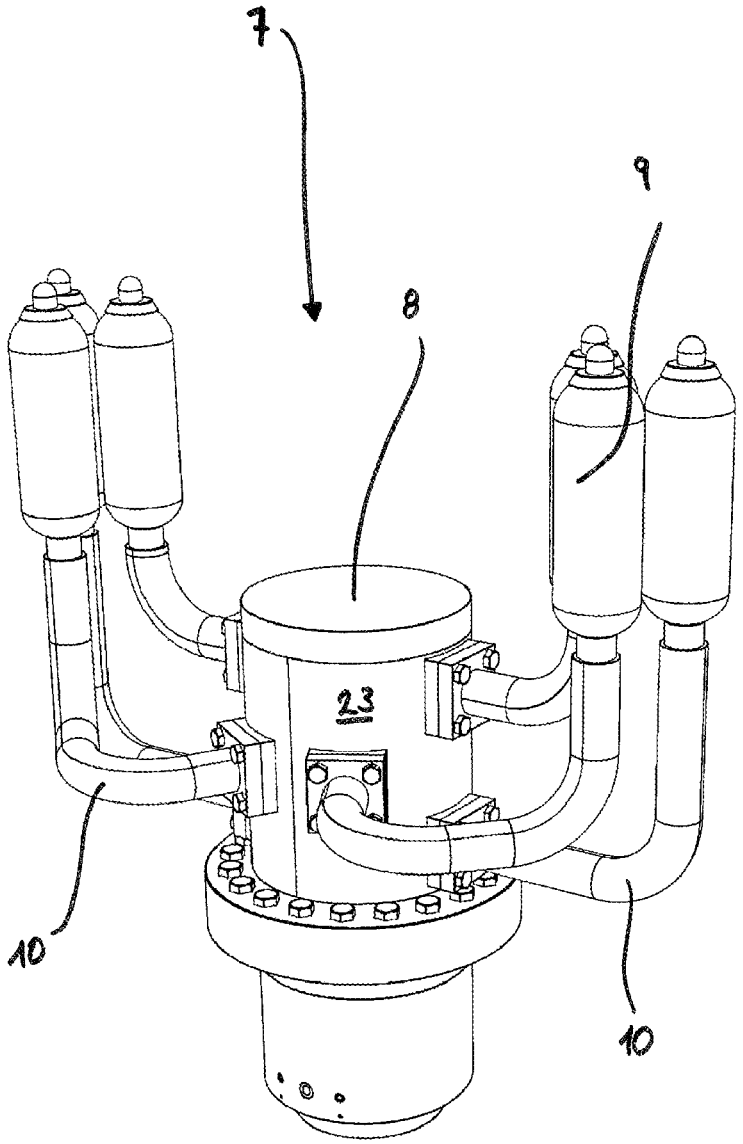
FIG. 3 illustrates a detail of a contact pressure device of the grinding device according to FIG. 2.

In a detail of the contact pressure device 7 which is illustrated in FIG. 3 an individual hydraulic cylinder 8, six connection components 10 connected therewith and a respectively associated gas spring 9 are visible particularly well. A cylinder operating chamber of the hydraulic cylinder 8 is completely filled with the hydraulic fluid so that the connection components 10 can be easily connected at an outer jacket 23 of the hydraulic cylinder 8 with an elevation offset. An illustrated "vertical" arrangement of the gas springs 9 in which the respective connection component is connected at the gas spring 9 at a bottom side of the respective gas spring 9 and the gas cushion is arranged in an upper section of the gas spring 9, is particularly advantageous in order to prevent that the gas cushion is flow enveloped or enclosed by the hydraulic fluid as can be the case for a reverse arrangement of the connection component 10 and the gas cushion.

Figure 4:
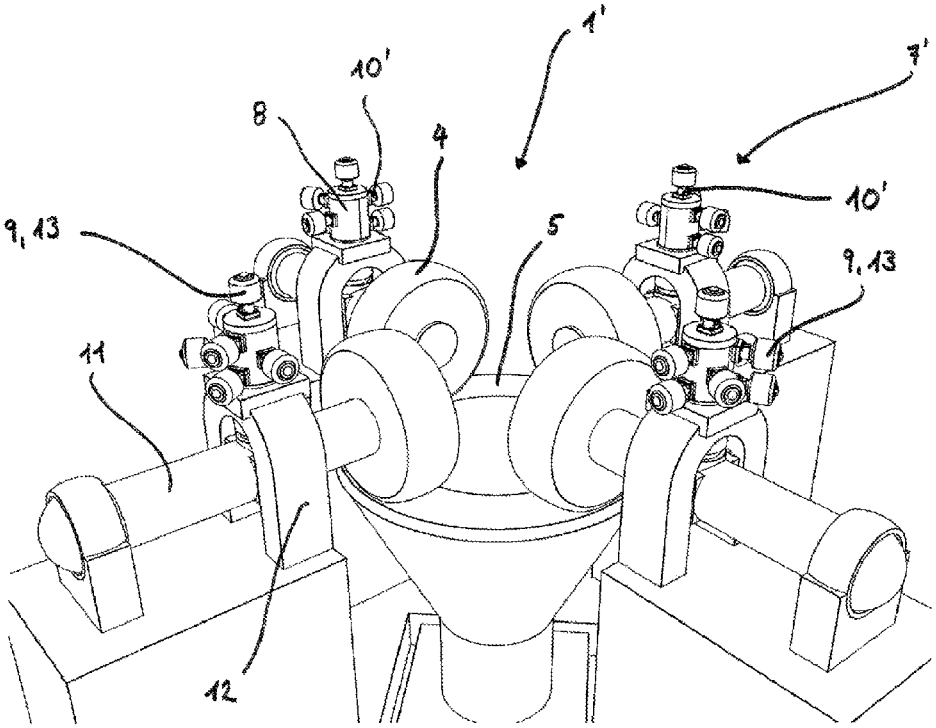
FIG. 4 illustrates another grinding device according to the invention with a plurality of individual gas springs configured as bladder reservoirs.

In another embodiment which is illustrated in FIG. 4 the gas springs 8 of a contact pressure device 7' of a grinding device 1' are formed by bladder accumulators 13 which are respectively individually connected analogously to the grinding device 1 illustrated in FIGS. 2 and 3 by a proper connecting component 10' at the hydraulic cylinder 8. In the illustrated embodiment a total of seven gas springs 9 or bladder accumulators 13 are provided. Bladder accumulators 13 are easily available in many shapes so that the grinding device 1' is an embodiment that can be installed quickly and economically when modernizing existing grinding devices.

Figure 5:
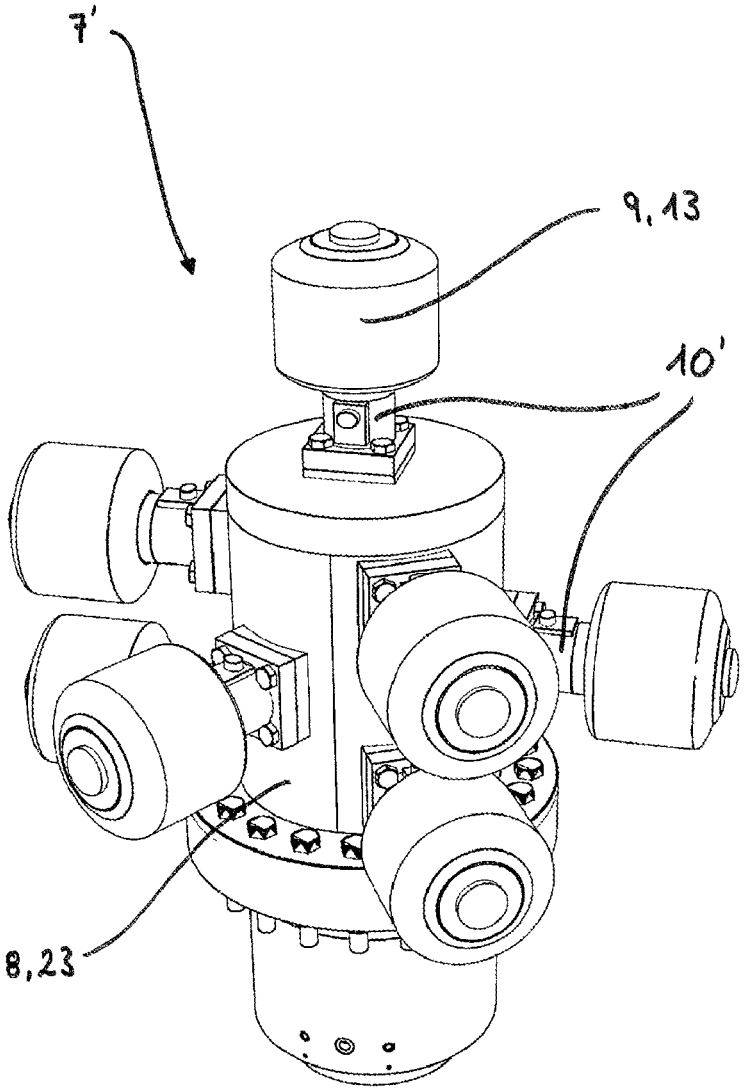
FIG. 5 illustrates a detail of a contact pressure device of the grinding device according to FIG. 4.

For illustration purposes FIG. 5 depicts a detail of the bladder accumulator 13 that is arranged at the cylinder operating chamber of the hydraulic cylinder 8. The connection elements 10' thus include a cross sectional surface which approximately corresponds to 60% of the cross sectional surface of the hydraulic cylinder 8. Furthermore the connection components respectively include a throttle element.

Figure 6:
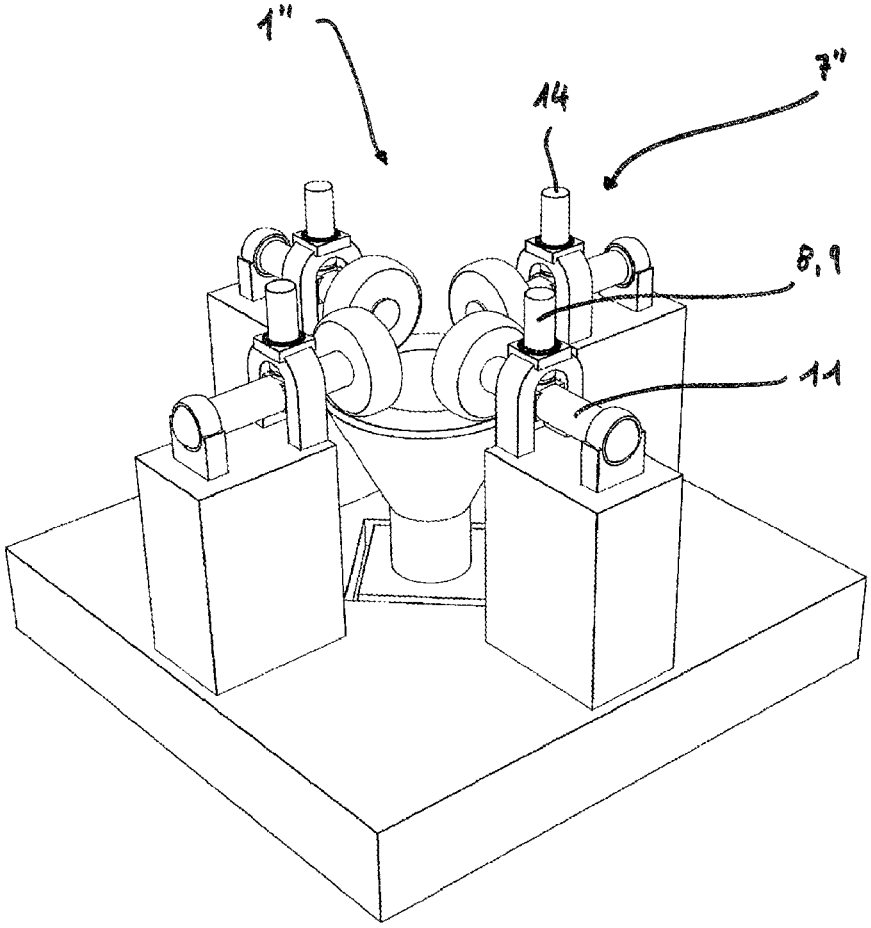
FIG. 6 illustrates another grinding device according to the invention with an integral embodiment of a cylinder operating chamber and a spring operating chamber.

Another embodiment which is illustrated in FIG. 6 includes an additional grinding device 1' according to the invention whose contact pressure device 7' differs from the contact pressure device of the remaining embodiments. The hydraulic cylinder 8 and the gas spring 9 of the contact pressure device 7" are configured as an integral component, this means the cylinder operating chamber and the spring operating chamber transition into one another seamlessly while maintaining a constant cross section and are no longer discernably separated from one another. This means for the illustrated contact pressure device 7" that the piston protrudes into the hydraulic cylinder 8 from the bearing axle 11, thus from below, and that the piston is supported axially moveable in the hydraulic cylinder 8. The hydraulic fluid typically a hydraulic oil is arranged on a side of the piston which is oriented away from the bearing axle 11. In so far the configuration of the contact pressure device 7' corresponds to the configuration of the contact pressure devices 7 and 101.

However in the contact pressure device 7" the gas spring 9 is not configured separately any longer but integrated directly at a "top side" of the hydraulic cylinder 8 which renders a discernable differentiation of the cylinder operating chamber and the contact pressure device 7" impossible. Thus, the gas cushion associated with the gas spring 9 is arranged at a top side 14 of the contact pressure device 7", wherein the gas cushion is preloaded. The hydraulic fluid directly contacts the gas cushion so that the cylinder operating chamber and the spring operating chamber are jointly arranged in a continuous space.

The variant of the grinding device 1" illustrated in FIG. 6 is particularly advantageous. In particular according to the definition the ratio of the smallest cross sectional surface between the hydraulic cylinder 8 and the gas spring 9 relative to the cross sectional surface of the cylinder operating chamber is equal to one, whereas the connection distance between the cylinder operating chamber and the spring operating chamber according is equal to zero per definition. Thus, this embodiment includes the best possible combination of hydraulic cylinder 8 and gas spring 9 which is furthermore producible in a particularly simple and cost effective manner.

Figure 7:
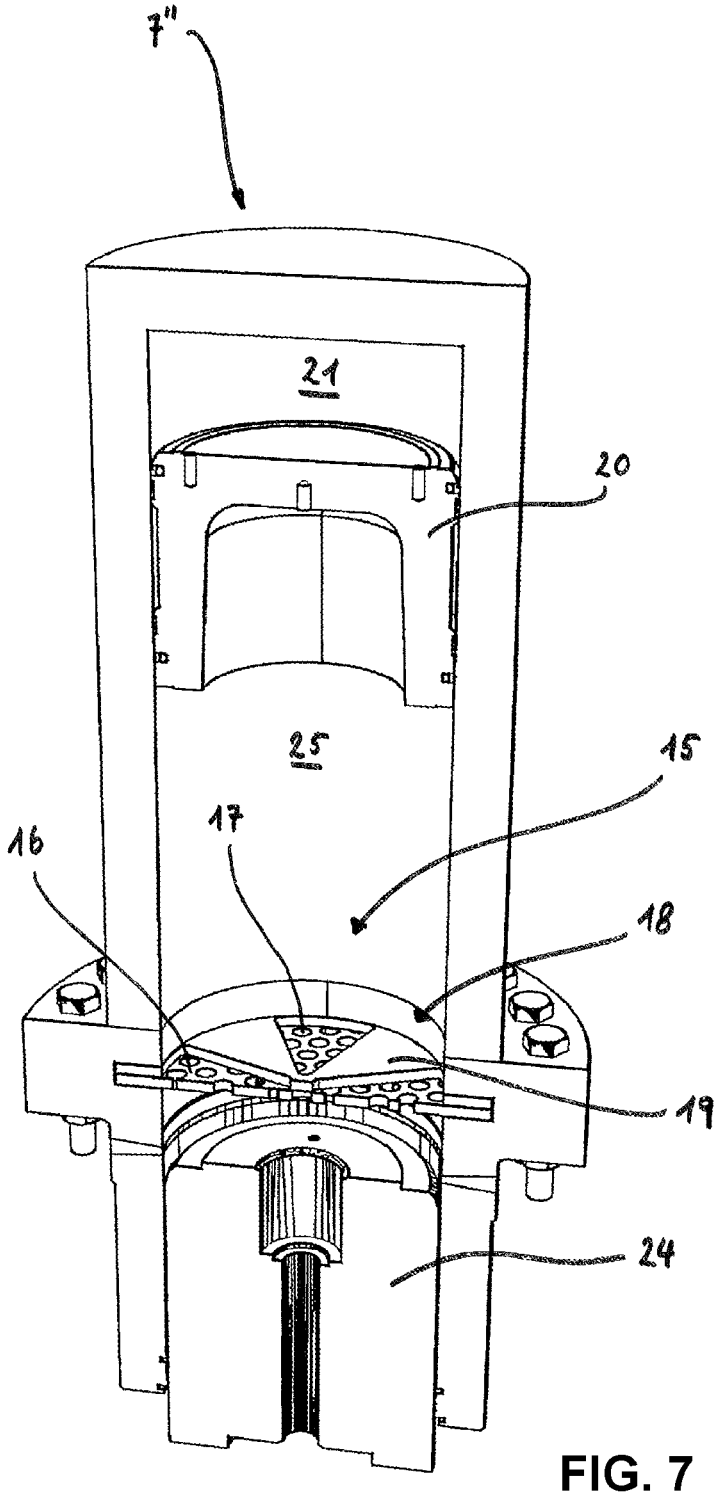
FIG. 7 illustrates a sectional view through a contact pressure dev e of the grinding device according to FIG. 6.

FIG. 7 eventually illustrates a detail of the contact pressure device 7", wherein the contact pressure device 7" is illustrated in a longitudinal sectional view. The hydraulic cylinder 8 is configured herein as so called "plunger cylinder", wherein a plunger piston 24 is arranged in a lower portion of the contact pressure device 7". A center portion 25 of the contact pressure device 7" is filled with the hydraulic fluid wherein the center portion 25 is arranged in front of a portion 21 of the contact pressure device 7 that includes the gas cushion formed by nitrogen. The gas cushion is separated in a sealing manner by a separation piston 20 from the hydraulic fluid, wherein the separating piston 20 is supported in a "floating manner" in the contact pressure device 7" so that it can move freely in an axial direction of the contact pressure device 7".

A damping device 15 configured as a throttle plate 16 is particularly significant in this respect. The throttle plate 16 includes a plurality of pass through openings 17 which form a constriction of the flow cross section of the hydraulic fluid in the contact pressure device 7". The damping device 15 is interpreted herein as a component that is arranged strictly for damping purposes and not a connecting component in the sense of the connecting components 10 and 10' of the embodiments described supra.

An interpretation of this type of the illustrated damping device 15, however, is still possible. Thus, in the sense of claim 1 the throttle plate 16 represents the connecting component between the cylinder operating chamber and the spring operating chamber, wherein the cylinder operating chamber is arranged on the side of the throttle plate 16 oriented towards the plunger piston 24 and the spring operating chamber is arranged accordingly on a top side of the throttle plate. The transition cross sections would be formed according to claim 1 by the transitions from the respective operating chambers (cylinder and spring operating chambers) to the pass through openings 17, wherein the connection distance would correspond to a length, this means to an extension of the throttle plate 16 in an axial direction of the contact pressure device 7" (thickness of the throttle plate 16). The throttle plate 16 has a thickness of 1 cm so that a risk of stiffening the contact pressure device 7' as provided in the prior art is not provided due to the small masses that need to be accelerated.

The damping device 15 provides a flow resistance when the hydraulic fluid flows through the pass through openings 17 with the hydraulic fluid wherein the flow resistance is opposite to the flow direction and leads to a braking of the hydraulic fluid or to a reduction of its flow velocity. A resistance of the damping device 15 is thus proportional to the flow velocity of the hydraulic fluid.

The damping device 15 furthermore includes a blocking device 18. The blocking device 18 is rotatable about a vertical longitudinal axis of the contact pressure device 7" relative to the throttle plate 16, wherein solid, herein triangular blocking elements 19 of the blocking device 18 are configured to move over the pass through openings 17 of the throttle plate 16 and thus close the throttle plate 16. Simultaneously a free portion below the blocking elements 19 which is not visible in FIG. 7 is released in that a flow cross section between a top side and a bottom side of the damping device 15 is configured without installations. Consequently the damping device 15 is illustrated in the position shown in FIG. 7 in its maximum damping position since all free portions are closed and only portions are released in which the hydraulic fluid has to be "pressed" through the pass through openings 17 of the throttle plate 16 which creates the desired friction. Rotating the blocking device 18 can be used to flexibly adapt a level of damping of the damping device 15.

REFERENCE NUMERALS AND DESIGNATIONS

1, 1, 1' grinding device
2 grinding element
3 grinding element
4 roller

5 grinding plate
6, rotation axis
7, 7' contact pressure device
8 hydraulic cylinder
9 gas spring
10, 10 connecting component
11 bearing axle
12 load frame
13 bladder accumulator
14 top side
15 damping device
16 throttle plate
17 pass through opening
18 blocking device
19 blocking element
20 separating piston
21 portion
22 foundation
23 jacket
24 plunger piston
25 jacket
100 grinding device
101 contact pressure device
102 connecting component

What is claimed is:

1. A grinding device for grinding a grinding material, the grinding device comprising:

at least two grinding elements that are movable relative to one another, wherein the at least two grinding elements together form at least one grinding portion in which the grinding material is grindable by the at least two grinding elements; and at least one contact pressure device including at least one hydraulic cylinder including a cylinder operating chamber, and at least one gas spring including a spring operating chamber, wherein the cylinder operating chamber and the spring operating chamber are flow connected with one another, wherein a contact force is impartible upon at least one of the at least two grinding elements by the at least one contact pressure device and the at least two grinding elements are pressable onto one another by the contact force, wherein a smallest flowable cross-sectional surface between the cylinder operating chamber and the spring operating chamber amounts to at least 40% of a cross-sectional surface of the cylinder operating chamber.

2. The grinding device according to the claim 1, wherein a smallest flowable cross sectional surface between the cylinder operating chamber and the spring operating chamber amounts to at least 60% of a cross sectional surface of the cylinder operating chamber.

3. The grinding device according to claim 1, wherein the at least one gas spring is formed by a bladder accumulator.

4. The grinding device according to claim 1, wherein the at least one hydraulic cylinder and the at least one gas spring are configured as an integrated contact pressure device, wherein the cylinder operating chamber and the spring operating chamber transition into one another with a constant cross section, and wherein the hydraulic fluid is arranged between a piston of the contact pressure device and a gas cushion of the contact pressure device.

5. The grinding device according to claim 1, wherein the contact force that is applicable by the contact pressure device is variable.

6. The grinding device according to claim 1, wherein a drive power of the grinding device is at least 0.2 MW or a volume pass through of the grinding material of the grinding device is at least 5 tons per hour.

7. The grinding device according to claim 1, wherein the at least one hydraulic cylinder and the at least one gas spring form a closed hydraulic system.

8. The grinding device according to claim 1, wherein the at least one hydraulic cylinder includes exactly one cylinder operating chamber.

9. The grinding device according to claim 1, wherein a drive power of the grinding device is at least 0.2 MW and a volume pass through of the grinding material of the grinding device is at least 5 tons per hour.

10. A grinding device for grinding a grinding material, the grinding device comprising:

at least two grinding elements that are movable relative to one another, wherein the at least two grinding elements together form at least one grinding portion in which the grinding material is grindable by the at least two grinding elements; and at least one contact pressure device including at least one hydraulic cylinder including a cylinder operating chamber, and at least one gas spring including a spring operating chamber, wherein the cylinder operating chamber and the spring operating chamber are flow connected with one another, wherein a contact force is impartible upon at least one of the at least two grinding elements by the at least one contact pressure device and the at least two grinding elements are pressable onto one another by the contact force, wherein a smallest flowable cross-sectional surface between the cylinder operating chamber and the spring operating chamber amounts to at least 10% of a cross-sectional surface of the cylinder operating chamber, or wherein a connecting section extending between a first transitional cross-section of a connecting component communicating with the cylinder operating chamber and a second transitional cross-section of the connecting component communicating with the spring operating chamber has a maximum length of 100 cm;

the grinding device further comprising a damping device through which a flow velocity of a hydraulic fluid flowing between the cylinder operating chamber and the spring operating chamber is reducible, wherein a degree of damping of the damping device differs advantageously for different flow directions of the hydraulic fluid, and wherein the degree of damping for a flow of the hydraulic fluid into a direction oriented away from a piston of the hydraulic cylinder is advantageously greater than for a flow of the hydraulic fluid in a direction oriented towards the piston of the hydraulic cylinder.

11. The grinding device according to the claim 10, wherein the degree of damping of the damping device is variable as a function of the direction of the flow of the hydraulic fluid.

12. The grinding device according to claim 10, wherein the damping device is formed by a throttle plate including pass through openings, and wherein the damping device includes at least one blocking device which is moveable relative to the throttle plate and through which blocking device the pass through openings of the throttle plate are at least partially closeable.

13. The grinding device according to claim 10, wherein the damping device includes a throttle cross section which is sized differently as a function of a direction of the flow of the hydraulic fluid, and wherein the throttle cross section is advantageously larger when the hydraulic flows in a direction oriented away from the piston of the hydraulic cylinder, than when the hydraulic flows in an opposite direction.

* * * * *